United States Patent [19]

Athey

[11] 3,993,806

[45] Nov. 23, 1976

[54] FLOCKING NON-WOVEN FABRICS

[75] Inventor: Graham Athey, Harrogate, England

[73] Assignee: Imperial Chemical Industries Limited, London, England

[22] Filed: Mar. 9, 1972

[21] Appl. No.: 233,149

[30] Foreign Application Priority Data

Feb. 22, 1971 United Kingdom ..... 5094/71

[52] U.S. Cl. ..... 427/206; 427/196; 427/201; 428/90; 428/288

[51] Int. Cl.[2] ..... B05D 1/14; B05D 1/16; B05D 1/36

[58] Field of Search ..... 161/64, 67, 150, 157, 161/169, 170, 175; 117/26, 28, 33; 428/90, 288; 427/185, 196, 201, 206

[56] References Cited

UNITED STATES PATENTS

| | | | |
|---|---|---|---|
| 3,459,579 | 8/1969 | Newman | 161/64 |
| 3,496,054 | 2/1970 | Baigas | 161/64 |
| 3,551,271 | 12/1970 | Thomas | 161/150 |
| 3,616,167 | 10/1971 | Gosden | 161/150 |

*Primary Examiner*—Marion E. McCamish
*Attorney, Agent, or Firm*—Cushman, Darby & Cushman

[57] ABSTRACT

A bonded non-woven fabric comprises a non-woven layer containing multicomponent, preferably bicomponent, fibers or filaments bonded to each other at cross-over points by means of adhesive derived from at least one of the components, with flock fibers bonded to at least some of the fibers or filaments of the non-woven layer, said flock fibers being oriented in all directions and some, preferably most of the flock fibers penetrating into or through the non-woven layer.

A method of making such non-woven fabrics comprises forming and bonding a non-woven layer of multicomponent fibers or filaments, applying adhesive thereto, applying flock fibers, preferably as a suspension in a gaseous fluid, and finally drying or curing the adhesive.

4 Claims, 2 Drawing Figures

FLOCKING NON-WOVEN FABRICS

Figure 1:
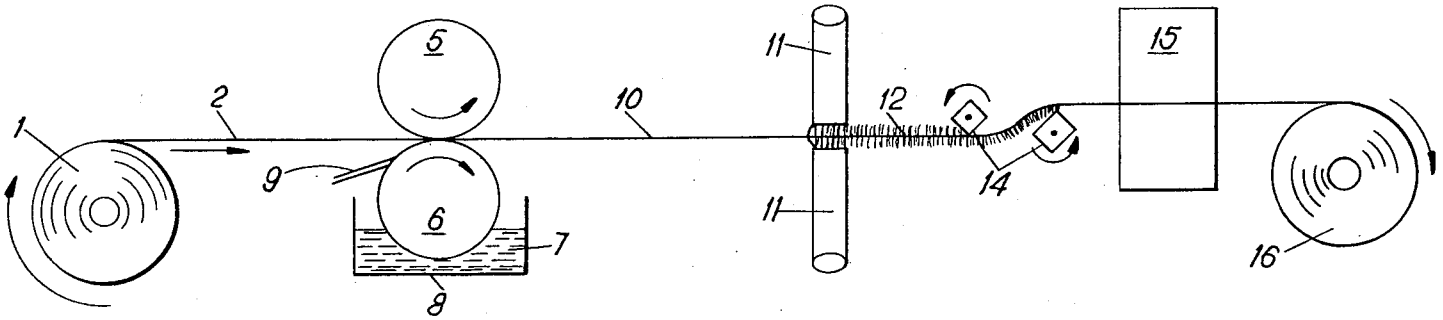

The invention relates to non-woven fabrics. More particularly, it relates to non-woven fabrics comprising a non-woven web to which flock fibres are adhered. Such fabrics are referred to hereinafter as flocked fabrics.

Flocked fabrics in which flock fibres have been bonded by adhesive to a base of non-woven web have been described. In some cases the same adhesive has been used to bond the fibres or filaments of the base web and also to bond the flock fibres to the web. In other cases, the base web has been bonded before the application of flock fibres, for example, by applying an adhesive to the web, or by making the web from a blend of homogeneous fibres, one specie of homogeneous fibres being subsequently rendered adhesive to bond the web under conditions which leave the other species unaffected. To such bonded webs flock has been bonded by use of a second adhesive.

Examination of such fabrics shows that their structure is more or less laminar, there being surface layers of flock fibres bonded to a non-woven base layer, with little if any, penetration of the flock fibres into the base layer.

In prior art flocked fabrics there has been the conflicting requirements of strength and drapeability on the one hand, and good flock cover without linting on the other hand. Thus if a large total quantity of adhesive is used, good flock cover can be obtained without linting, but the product is stiff and has inadequate tear strength. Again, if a relatively small total quantity of adhesive is used, a drapeable product with a good tear strength is obtained, but the flock cover is poor and the product lints unacceptably. Whilst a compromise on physical properties, cover and linting properties is possible to a certain extent, its production has to be meticulously controlled in order to avoid unacceptable variability in the product.

We have now invented a flocked fabric in which the above disadvantages are substantially eliminated.

Accordingly, from one aspect, the invention provides a bonded non-woven fabric, comprising a non-woven layer containing multi-component fibres or filaments bonded to each other at cross-over points by means of adhesive derived from at least one of the components, and flock fibres bonded to at least some of the fibres or filaments of the non-woven layer by an adhesive, said flock fibres being oriented in all directions and at least some, preferably a majority of the flock fibres penetrating into or through the said non-woven layer.

In a preferred embodiment the non-woven layer constitutes between 20 and 40% of the total fabric weight, the adhesive constitutes between 8 and 28%, preferably 10 to 20% of the total fabric weight, and the flock fibres should constitute not more than 60% of the total fabric weight.

The fabric of the invention preferably weighs between 25 and 120 g $m^{-2}$, more preferably between 26 and 45 g $m^{-2}$.

The base web may be fabricated of continuous filaments or staple fibres or both, and the term "fibres" is used hereinafter as having this meaning, unless otherwise qualified. Preferably, however, the base web is composed of continuous filaments.

At least some of the fibres of the base web are multicomponent in nature, although bicomponent fibres are preferred. The components are chosen so that one of them, occupying at least a proportion of the peripheral surface of the fibres, can be rendered adhesive by a treatment which leaves the other component unaffected. Solvent, chemical or heat treatment may be employed to bond the web. However, too high a bond density or too high a bond strength may cause the base web tensile properties and handle to be deleteriously affected.

The components of the multicomponent fibres are conveniently composed of synthetic polymers, such as polyamides, polyesters and polyolefins. As examples of suitable multi-component fibres for use in the base web, there may be mentioned bicomponent fibres having one component of poly(hexamethylene adipamide) and a second component of poly(ε-caprolactam) or a copolymer of hexamethylene adipamide and ε-caprolactam and those with one component of poly(ethylene terephthalate) and a second component of a copolymer of ethylene adipate and ethylene terephthalate. Other suitable combinations of polymers will be readily discernible to those skilled in the art.

If the components are symmetrically arranged around the axis of the fibre, then a fibre which does not possess the property of potential crimp will be obtained. Thus in a bicomponent fibre, a concentric core-sheath configuration will not show potential crimp. However, if the components are assymetrically arranged around the axis of the fibre, the fibre may, depending on the polymers chosen for components, possess potential crimp — for example, bicomponent fibres having eccentric core-sheath, or side-by-side configurations. The latter fibres can be made to develop helical crimp during the bonding treatment and we find that the use of such filaments gives a flocked fabric according to the invention which can stretch elastically in all directions.

The base web may also contain other fibres which are not sensibly affected during the bonding treatment. Generally, these fibres will be present as not more than 50% of the total fibre content. The use of such fibres may be desirable in order to reduce the number of bonds between multicomponent fibres and hence to improve the tensile properties and handle as mentioned above.

Synthetic polymeric fibres, such as polyamides, for example, poly(hexamethylene adipamide), polyesters, for example, poly(ethylene terephthalate) or polyolefins, such as polypropylene, or natural fibres, for instance, silk, wool or cotton, or artificial fibres such as rayon may be employed.

The uniformity of the properties of the final product is determined by the uniformity of the properties of the base web, as well as by the uniformity of the flock distribution and therefore care must be taken to ensure that the web is at least substantially uniform in weight per unit area. The base web may be treated in any conventional manner, for example steaming before adhesive and flock are applied to it.

The individual base web filaments should, preferably, be less than 15 decitex, for example 5 decitex, since otherwise the base web is unduly stiff. An unduly compacted web should be avoided and a typical base web thickness for a product of weight about 35 g $m^{-2}$ may be, for instance, about 3 filament diameters. The interstitial spacing of the base web should be such that the flock fibres can penetrate into the web.

The flock fibres may be synthetic, artificial or natural fibres. Particularly preferred are those flock fibres which are highly contorted, convoluted, bent and curly, since these provide greater cover than relatively straight fibres. Thus, we prefer that the flock fibres are wood-pulp or $\alpha$-cellulose fibres since not only are these fibres highly contorted, but also the cheapness of such fibres makes the final product sufficiently cheap to be considered as a so-called disposable fabric. However, other flock fibres, for example, nylon flock, may be used if desired. Mean flock lengths in the region of 0.1–0.4 mm are preferable, although longer flock fibres may be used.

Any suitable adhesive may be used providing, of course, it is capable of adhesion to at least some of the fibres of the base web and also to the flock fibres. Preferred adhesives are those which can be applied as a dispersion in a liquid, particularly water. Acrylic resins are of particular utility since these may be applied as a dispersion in water, but, when cured form a cross-linked film which is resistant to water and many organic solvents. The hardness of the polymeric film will affect the properties of the finished product, as soft films give products having a soft handle with poor abrasion resistance, whereas hard films give products having good abrasion resistance but a harsh feel. The adhesive should be applied to the base web so that the fibres become substantially coated therewith but care should be taken to avoid films of adhesive bridging the web interstices.

The amount of adhesive also affects the physical properties of the final product. We find that as the amount increases, the tear strength of the product increases initially and then starts to fall. The position of the optimum tear strength depends on the degree of bonding in the base web. Increasing the level of adhesive also increases the stiffness and abrasion resistance of the final product. The adhesive should, for this reason, constitute between 8 and 28%, preferably between 10 and 20% of the weight of the finished product.

The fabrics of the invention may be made in a number of ways, all of which follow the basic pattern of, a. Manufacturing the base web
b. Bonding the base web
c. Applying adhesive to the web
d. Applying flock to the adhesive
e. Drying and optionally curing the adhesive The base web may be made in any known manner, such as for example, the methods described in UK Patent Specification Nos. 932,482 and 1,126,026. The methods described in our copending UK Specification No. 1,269,934 and our application for British Patent Ser. No. 48,186/69 are of particular utility.

The adhesive may be applied by spraying or by roller application. In the latter case use of a doctor knife and a gravure roll is found to ensure uniform application of adhesive.

The flock fibres may be applied from one side but preferably from both sides of the web. In the latter case the flock fibres projected onto one side of the base web may if desired have different properties to those of the flock fibres projected onto the base web from the opposite side.

The flock fibres should penetrate through or into the base web and thus we prefer to apply the fibres to the web from a stream of fluid. The apparatus described in our copending British application Ser. No. 39,841/71 is of particular use in applying the flock fibres uniformly to the base web.

Desired properties can be imparted to the finished product by adding, for example, flammability retardants, water repellants, optical brighteners, antistatic agents and pigments to the adhesive applicator. The invention is further described in the accompanying drawing, in which, FIG. 1 shows schematically apparatus for making the product of the invention.

Figure 2:
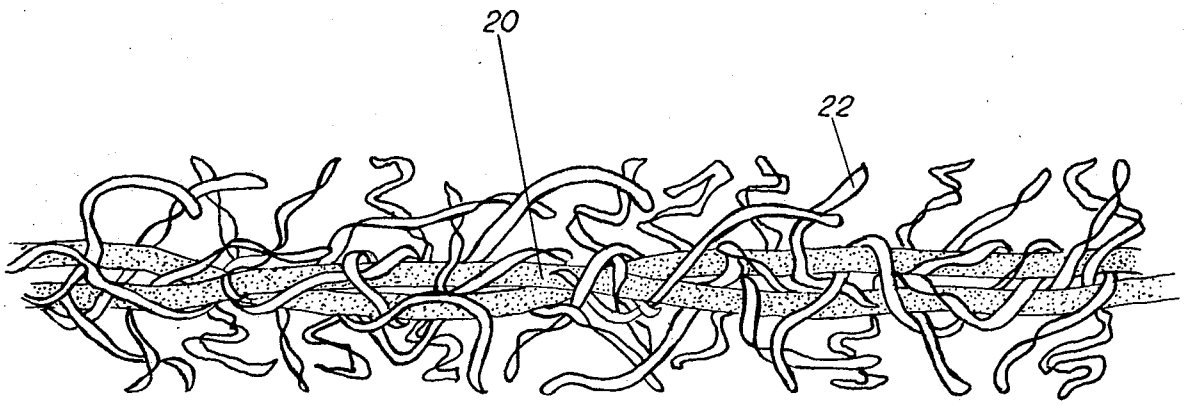

FIG. 2 is a sketch based on a photomicrograph of a cross-section through the product of the invention.

Referring now to FIG. 1, reference numeral 1 indicates a roll of a bonded non-woven web which is supported at one end of the apparatus. Base web 2 is unrolled from roll 1 and is passed between nip rolls 5, 6, roll 6 being a gravure roll contacting adhesive 7 contained in bath 8. Doctor blade 9 ensures even distribution of adhesive along the length of roll 6 and hence across the width of web 2.

The base web coated with adhesive (designated 10) is advanced to flock applicators 11 situated above and below the web 10, whereat flock fibres, advanced from storage hoppers (not shown) in an air stream are projected uniformly onto the web, contacting and adhering to the adhesive.

More uniform flocking may be achieved if the flocked web (designated 12) is beaten or calendered before the adhesive is cured, and reference number 14 indicates such beaters. Web 14 passes through a hot dry zone 15 in which the adhesive is cured, and the product is subsequently wound up on roll 16.

A cross-section through the product is shown in FIG. 2. The filaments of which the base web is constituted are designated by reference numeral 20, and the flock fibres are indicated by reference numeral 22. It will be seen that the base web is about 3filament diameters in thickness and that a large proportion of the flock fibres penetrate into and through the base web. No orientation of the flock fibres 27 in a preferred direction can be discerned.

The invention is further described in the following examples which in no way limit the scope of the invention as claimed.

EXAMPLE 1

In this example continuous bicomponent filaments were used. The filaments had an extensibility to break of about 150% and a decitex of 5 per filament, and the components were arranged in a core-sheath configuration. The core was nylon 66 and the sheath was nylon 6, the core weighing about 65% of the total filament weight. From these filaments a web weighing 12 g $m^{-2}$ was manufactured by forwarding the freshly spun filaments onto a collecting surface by means of a traversing pneumatic forwarding device. The web so produced was wound up as a roll, interleaved with tissue paper, and the roll was subsequently passed through an atmosphere of steam at 1.75 Kg $cm^{-2}$ at a speed giving a residence time of some 5 secs, which treatment bonded the filaments of the web together by softening the nylon 6 sheath. The bonded web was rewound as a roll, the interleaving tissue paper being discarded. This roll of web was used as the feed stock for the apparatus illustrated in FIG. 1 of the accompanying drawing.

The adhesive employed was a self-linking acrylic copolymer, designated Primal HA8, manufactured by Rohm and Haas, emulsified in water to give about 50% solids. The amount of solids applied to the web was adjusted to about 2 g.m$^{-2}$.

Flock fibres were applied to both sides of the web coated with adhesive to give 20 g m$^{-2}$. The flock fibres were composed of α-cellulose and had a nominal mean length of 0.3 mm.

Finally the adhesive was cured by passage through a hot air oven, the temperature of which was 150° C and the residence time was 180 sec.

The physical properties of the product were as follows:

| | | |
|---|---|---|
| Weight | : | 33.0 g m$^{-2}$ |
| Tear strength | : | Machine direction: 1.9 Kg |
| | | Cross machine direction: 2.1 Kg |
| Extension | : | Machine direction: 42% |
| | | Cross machine direction: 45% |
| Burst strength | : | 430 g cm$^{-2}$ |
| Tensile strength | : | Machine direction: 1.4 Kg |
| | | Cross machine direction: 1.3 Kg |

The product was a lightweight drapeable fabric having good tear strength, burst strength and breaking load. It had excellent drape, stretch properties and crease resistance. It could be dyed, printed, cut without fraying, sewn, glued and sterilised by conventional techniques.

The properties of the product made it suitable for fabric outlets, such as bed sheets, pillowcases, surgical gowns and masks, hospital drapes, tablecloths, handkerchiefs, wiping cloths, bibs, underwear, nappy linings and covers, incontinence and sanitary pad covers, and apparel.

EXAMPLE 2

A 12 g m$^{-2}$ non-woven web was made by laying freshly spun continuous filaments onto a collecting surface by means of a traversing pneumatic forwarding device. The filaments were three decitex core-sheath bicomponent in nature, having a core of nylon 66 and a sheath of nylon 6, in equal proportions.

The web so produced was passed between two calender rolls heated to 190° C, at a speed of 3 m min$^{-1}$, which treatment served to bond the web.

The bonded web was passed through an adhesive applicator wherein 4 g m$^{-2}$ of adhesive were applied. The adhesive was the same self-linking acrylic resin used in Example 1.

Subsequently 7 g m$^{-2}$ flock fibres were applied to both sides of the web, the flock fibres being the same as those used in Example 1.

Finally the product was dried and cured by passing it through a hot air oven, wherein the product reached a temperature of 140° C and was held at the temperature for 2 mins.

The product had the following properties:

| | | |
|---|---|---|
| Weight | : | 30 g m$^{-2}$ |
| Tear Strength | : | Machine direction: 1.3 Kg |
| | | Cross machine direction: 1.1 Kg |
| Extension | : | Machine direction: 70% |
| | | Cross machine direction: 80% |
| Tensile Strength | : | Machine direction: 1.8 Kg |
| | | Cross machine direction: 1.7 Kg |

EXAMPLE 3

A fabric according to the invention was made in a similar manner to that described in Example 1, but using a base web composed of staple fibres. The staple fibres were a blend of 50% nylon 6.6 homofilaments and 50% bicomponent fibres, in which the core of nylon 6.6 was surrounded eccentrically by a sheath of nylon 6. Both fibre species were cut to 1½ length and had a count of 3 denier. The base web was prepared by carding and cross lapping in a conventional manner and weighed 10 g m$^{-2}$.

The product which weighed 64 g m$^{-2}$, was compared with the product of Example 1 and was found to be more bulky and to have better cover. Although the tensile properties were greatly inferior to those of the product of Example 1, nevertheless they compared favourably with the properties of commercially available disposable fabrics. The fabric was considered to be suitable for manufacture of wiping cloths and towelling.

EXAMPLE 4

In this example, 3.3 decitex bicomponent staple fibres having a length of 38 mm were used. The components were arranged in a sheath-core configuration, there being a core of nylon 6.6 and a sheath of nylon 6. These fibres were assembled into a web weighing 11 g m$^{-2}$.

The web was bonded in a hot air oven at a temperature of 225° C under which conditions the sheath component softened and adhered to adjacent fibres. On cooling a bonded web was obtained.

To this web was applied 4 g m$^{-2}$ of the acrylic resin employed in Example 1 and flock fibres (α-cellulose of length 0.3 mm) were applied to both sides of the web to a weight of 20 g m$^{-2}$. Finally the adhesive was cured in a hot air oven at 140° C for a residence time of 2 minutes.

The product was thicker (i.e. less dense) than the product of Example 1. However, it was considerably weaker, having a tensile strength of about 30% and a tear strength of 20%, compared wih the product of Example 1.

EXAMPLE 5

Example 2 was repeated, but the flock fibres were 0.3 mm length poly(hexamethylene adipamide) staple fibres. These were applied to both sides of the adhesive-coated base web to give a total weight of flock fibres of 14 g m$^{-2}$.

The resultant product appeared whiter than the product of Example 1, but had a harsher handle. The physical properties of the product were substantially the same as the properties of Example 2.

EXAMPLE 6

Example 1 was repeated but the flock fibres were 3 mm α-cellulose flock fibres. The product had substantially the same physical properties as the product of Example 2 but was more opaque and had a softer, silky handle.

What we claim is:

1. A process for making a bonded non-woven fabric having a non-woven base layer and flock fibres adhered thereto comprising sequentially the steps of i. forming a non-woven web containing multi-component fibres or filaments, at least one of which components can be rendered adhesive by a treatment which leaves the other components unaffected, ii. treating the non-woven web to render adhesive said component of the said multi-component fibres or filaments and thereby causing bonds to form between contiguous fibres or filaments, iii. applying an adhesive for at least some of the fibres and filaments of the base web and also for the flock fibres to the bonded non-woven web in such quantities that a substantial proportion of the continuous fibres or filaments are coated with adhesive, the adhesive not being derived from the multi-component fibres or filaments and not spanning the interstices between the fibres or filaments of the web, iv. applying flock fibres to both surfaces of the adhesively coated non-woven web by suspending the flock fibres in a stream of gaseous fluid and directing the stream into and through the non-woven web so that said flock fibres are oriented in all directions and a majority of said flock fibres penetrate into or through said non-woven layer and v. drying the adhesive.

2. A process as claimed in claim 1, wherein the treatment in step (ii) comprises heating the web to a temperature above the softening point of said at least one of the components but below the softening point of at least one of the components.

3. A process as claimed in claim 1, wherein the treatment in step (ii) comprises applying a solvent or plasticiser for said at least one but not all of the components.

4. A process as claimed in claim 1, wherein the adhesive applied in step (iii) is an acrylic resin supplied as a dispersion in water.

* * * * *

UNITED STATES PATENT OFFICE

CERTIFICATE OF CORRECTION

Patent No. 3,993,806 Dated November 23, 1976

Inventor(s) Graham Athey

It is certified that error appears in the above-identified patent and that said Letters Patent are hereby corrected as shown below:

In the heading, section [30], the foreign priority information now reads as follows:

"February 22, 1971, postdated to March 13, 1971 United Kingdom.....5094/71".

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*